United States Patent [19]

Jouret

[11] 4,107,483

[45] Aug. 15, 1978

[54] TIMER SWITCH ASSEMBLY HAVING CENTRIFUGAL DISPLACEMENT MECHANISM

[75] Inventor: Edouard Léon Clément Jouret, Bresso-Milano, Italy

[73] Assignee: Crouzet, Paris, France

[21] Appl. No.: 730,978

[22] Filed: Oct. 8, 1976

[30] Foreign Application Priority Data

Oct. 24, 1975 [FR] France ..... 75-32730

[51] Int. Cl.[2] ..... H01H 43/90; H01H 35/10

[52] U.S. Cl. ..... 200/35 R; 200/38 R; 200/38 F; 200/80 R

[58] Field of Search ..... 200/33 R, 35 R, 36, 200/37 R, 38 R, 38 A, 38 F, 38 FA, 80 R

[56] References Cited

U.S. PATENT DOCUMENTS

| | | | |
|---|---|---|---|
| 2,598,481 | 5/1952 | Young | 200/80 R X |
| 2,868,287 | 1/1959 | Estey | 200/35 R X |
| 2,946,902 | 7/1960 | Hagen | 200/38 F X |
| 3,515,972 | 6/1970 | Hurst | 200/80 R X |
| 3,639,135 | 5/1953 | Sloan | 200/80 R X |

FOREIGN PATENT DOCUMENTS 1,021,099 2/1953 France.

*Primary Examiner*—James R. Scott
*Attorney, Agent, or Firm*—Marmaduke A. Hobbs

[57] ABSTRACT

A timing device comprises a contact assembly, an acting switch and a centrifugal mechanism rotated by a synchronous motor, and a rotatable resiliently biased timing wheel. The acting switch, upon energization of the motor, is moved axially in a direction parallel to the rotary axis of the timing wheel by the centrifugal mechanism to a first position for rotating the said timing wheel and opening a contact between a movable contact plate and a first fixed contact plate of the contact assembly. The acting switch is maintained in the first position by the timing wheel, and is moved to a second position for maintaining the timing wheel in position and closing a contact between the movable contact plate and a second fixed contact plate of the contact assembly, whereby, upon deenergization of the motor, the switch is moved axially in the reverse direction to its normally inoperative state and said timing wheel is rotated back under the action of its biasing means.

2 Claims, 5 Drawing Figures

TIMER SWITCH ASSEMBLY HAVING CENTRIFUGAL DISPLACEMENT MECHANISM

BACKGROUND OF THE INVENTION

The invention relates to a timing device being the essential part of a switching means or which is included in a programmer for only forming a part of it.

It is concerned with improvements in timing devices, such as disclosed in the French patent 1 021 099 related to a switching means whose timing device comprises a synchronous reduction motor, a toothed timing wheel resiliently biased, a toothed pinion rotated by the motor, and an electromagnet for moving radially the toothed pinion into engagement with the toothed timing wheel.

This device can be used in different ways, and at the end of the preset timing, either the timing wheel, through an activating impulse, closes or opens a circuit assembly and simultaneously deenergizes the electromagnet, the timing wheel being then disengaged from the pinion and moved back to its initial position, or, the timing wheel closes or opens permanently a circuit assembly and simultaneously deenergizes the synchronous motor, the timing wheel being moved back to its initial position only upon deenergization of the electromagnet.

It is, therefore, the object of the present invention to provide a cheaper timing device in avoiding the need of an engaging electromagnet.

SUMMARY OF THE INVENTION

The invention relates to a timing device suitable for opening a first contact of a contact assembly and closing a second contact of the contact assembly. A toothed pinion rotated by a synchronous motor is moved axially by a centrifugal mechanism rotated by same motor to a first position in which the pinion engages a toothed timing wheel which prevents the pinion from keeping on moving axially. The timing wheel is then rotated by the pinion until a teethless part provided at the periphery of the timing wheel disengages the pinion from the timing wheel, whereupon the pinion is moved axially to a second position by the centrifugal mechanism and remains in this second position until the synchronous motor is deenergized.

Other objects and details of the invention, together with the method of operation thereof, will be clear from the following description and claims taken with the accompanying drawings in which is illustrated a preferred embodiment of the timing device according to the invention.

DESCRIPTION OF THE PREFERRED EMBODIMENT

Figure 1:
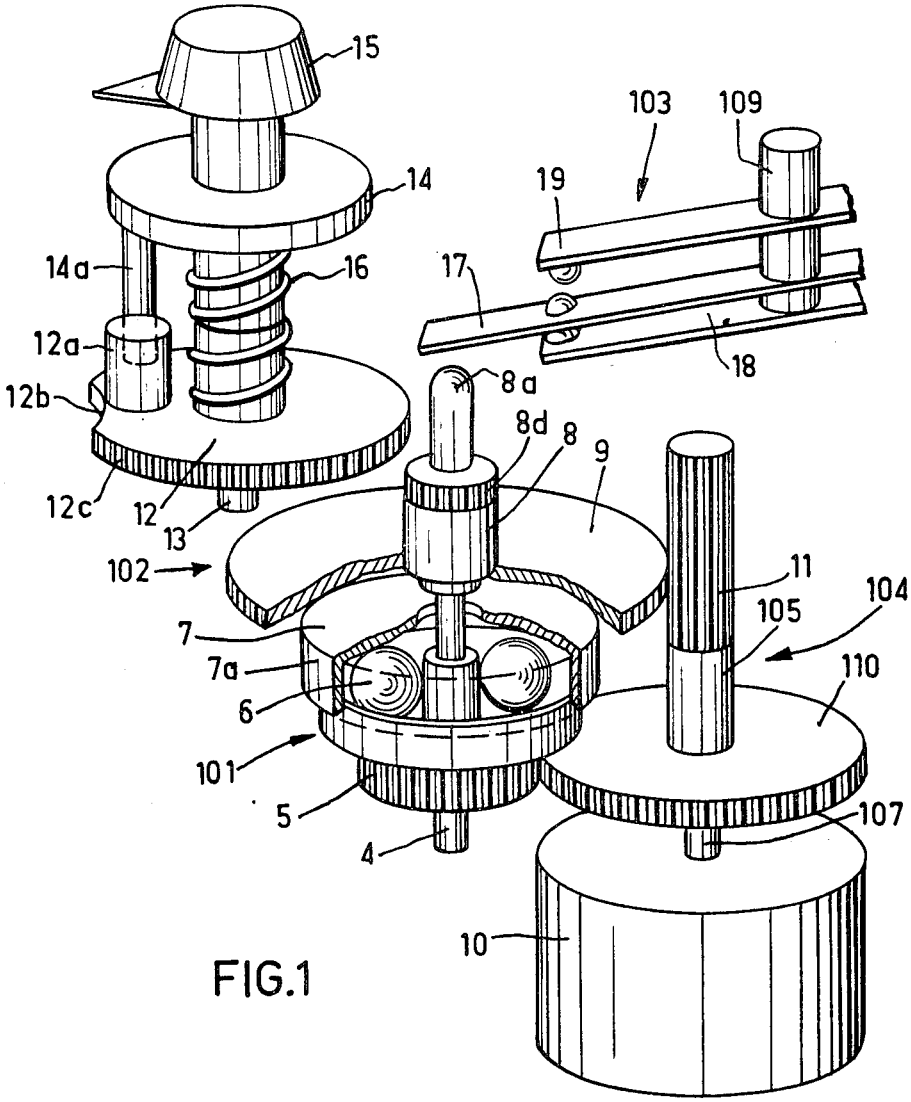
FIG. 1 shows the preferred embodiment of the timing device according to the invention, diagrammatically, in perspective.
Figure 2:
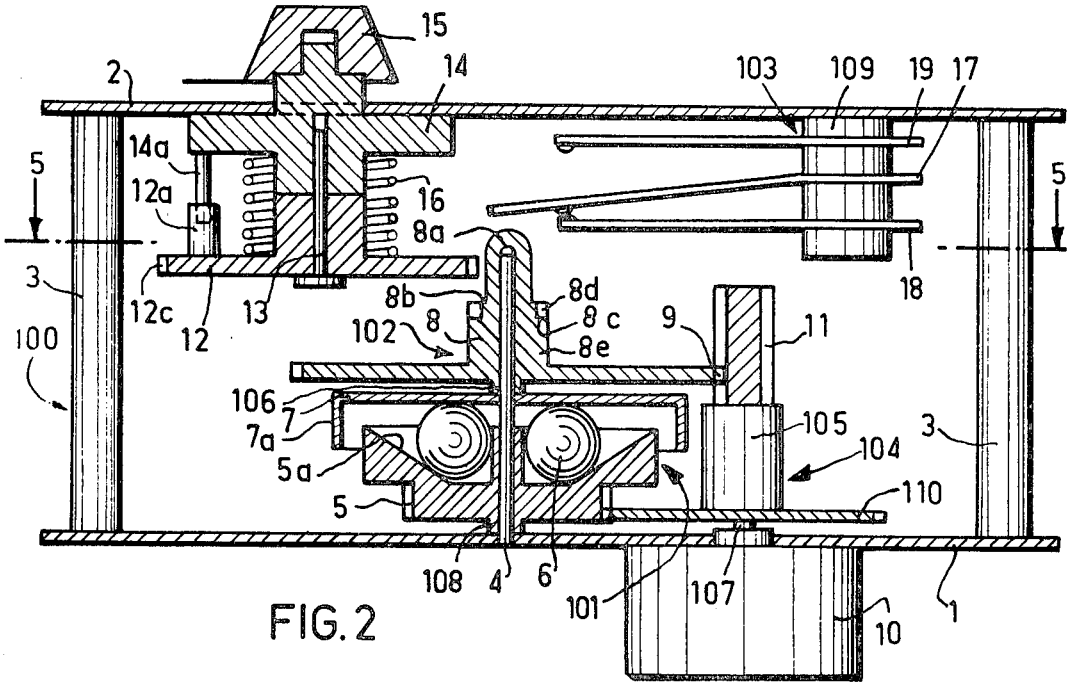
FIG. 2 is an elevation view in section of the timing device of FIG. 1, shown in its normal inoperative state.
Figure 3:
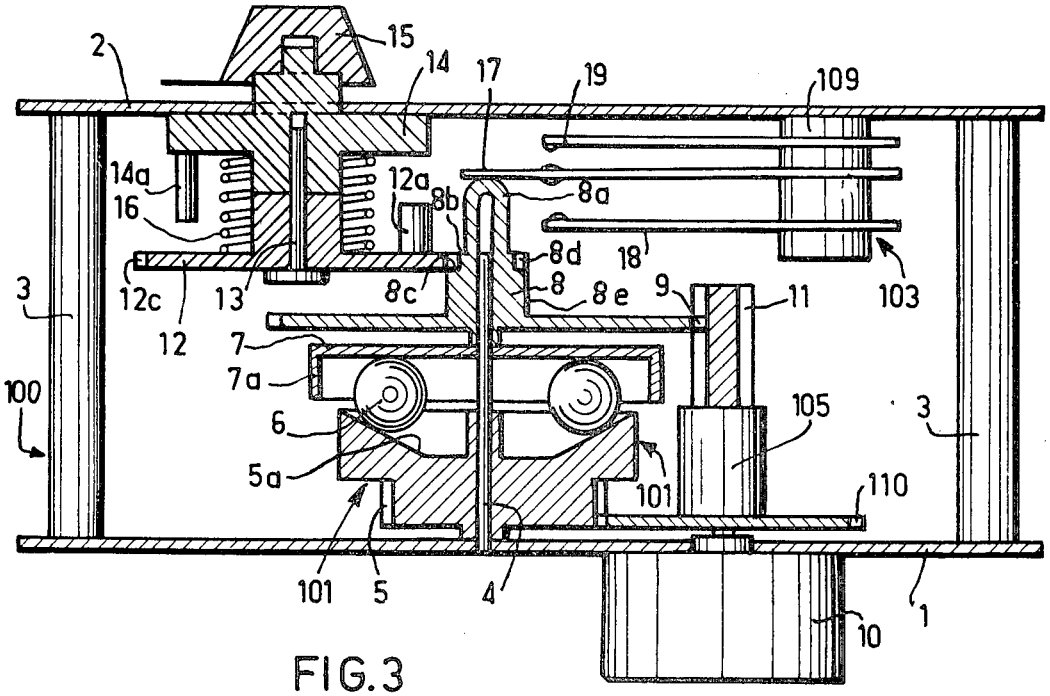
FIG. 3 is an elevation view in section of the timing device of FIG. 1, shown at the beginning of the timing.
Figure 4:
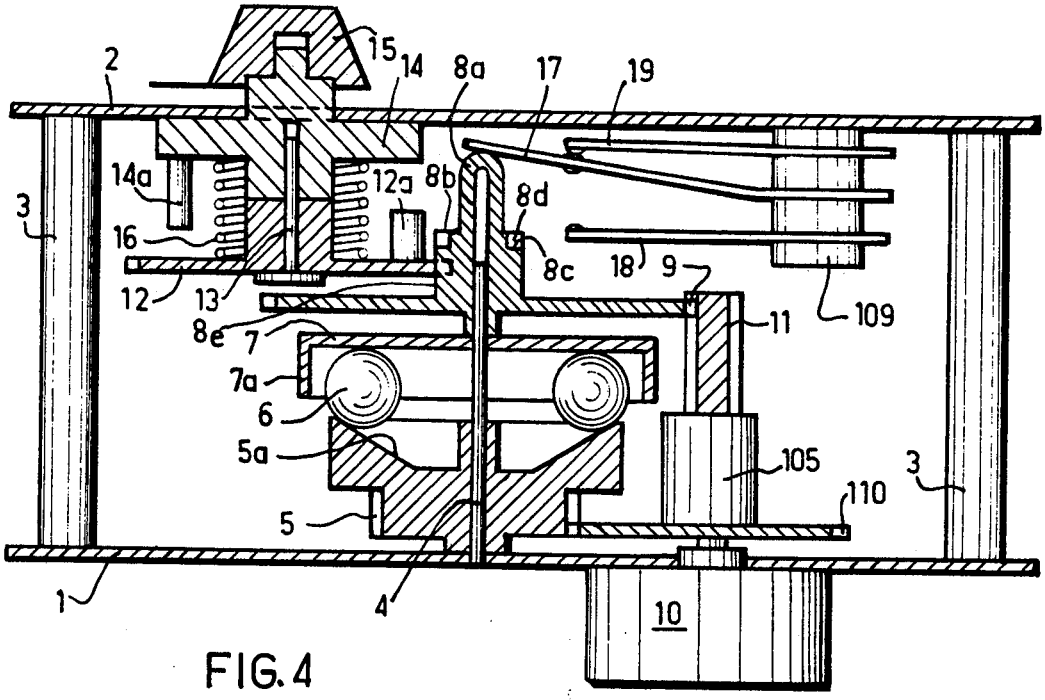
FIG. 4 is an elevation view in section of the timing device of FIG. 1, shown at the end of the timing.
Figure 5:
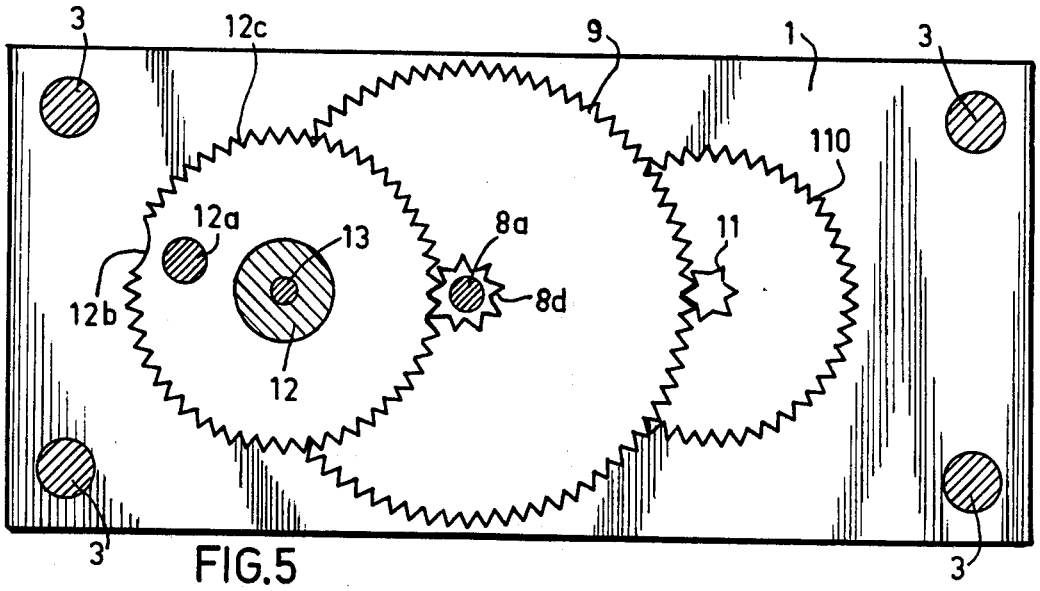
FIG. 5 is a plan view in section on line 5—5 of FIG. 2.

The timing device shown in FIGS. 1 through 5 comprises, in the main, a support frame indicated generally at 100 consisting of two support plates 1 and 2 supported by four support members 3.

Held between the support plates 1 and 2 are a freely rotatable holder, or centrifugal mechanism, indicated at 101, for holding weighted balls in a manner that will be described later, a freely rotatable and axially movable switch indicated at 102, a contact assembly indicated at 103, a timing wheel 12, and driving gears indicated generally at 104.

Suitably secured to the support plate 1 is a synchronous motor 10 for rotating the holder 101 and the switch 102 through the driving gears 104. Holder 101 is rotated at a fast rate of speed (around 1000 r.p.m.) by a first gear 110 of the driving gears 104 engaging with a toothed driven portion 5 formed on the ball holder 101 and extending axially therefrom. Switch 102 is rotated at a lower rate of speed by the last gear 11 of the driving gears 104 through reducing gears (not shown) in gear box 105, last gear 11 engaging with a first toothed driven portion 9 formed on switch 102 and extending radially therefrom. The last gear 11 has a rather great axial length, for a reason which will subsequently be made apparent.

Holder 101 is provided with an internal dished track or face **5*a* in which the above mentioned weighted balls 6 can ride freely. The weighted balls 6 cooperate with the corresponding face on an axially slidable actuating member 7, which engages an integral protusion 106 formed on switch 102 and extending axially from the driven portion 9. Balls 6 are effectively held from rolling out of dished track 5*a* of holder 101 by means of a ball-retaining strap 7*a* secured at the periphery of the actuating member 7**.

Holder 101 and switch 102 are axially aligned around an axis 4, parallel to the driving shaft 107 of the synchronous motor 10, extending perpendicularly to the support plate 1 and fixedly secured thereto.

Although two weighted balls 6 are shown on the drawings, it is within the purview of the invention to use more than two balls in the rotatable holder 101 for cooperating with the actuating member 7.

Rotatable holder 101 engages smoothly with the support plate 1 by means of a small integral protusion 108, formed on holder 101 and extending axially from the toothed driven portion 5, and provided with an axial aperture through which axis 4 extends.

Extending axially from the driven portion 9 of switch 102, at the opposite side of integral protusion 106, is an integral pinion 8 provided with a toothed driving portion **8*d* formed between two planes 8*b* and 8*c* perpendicular to the axis 4, plane 8*b* being more remote from holder 1 than plane 8*c*. The driving portion 8*d* of the pinion 8 is adapted to engage a toothed driven portion 12*c* formed at the periphery of the timing wheel 12**.

Extending axially from the driving portion **8*d* of pinion 8 of switch 102 is an integral actuating cap 8*a***.

As switch 102 is moving axially along axis 4, as will be explained herebelow, actuating cap **8*a* engages a movable contact plate 17 of the contact assembly 103. Contact assembly 103 includes the movable contact plate 17, extending over the actuating cap 8*a*, and two fixed contact plates 18 and 19, the contact plates 17, 18** and 19 being molded to an insulating body 109 suitably secured to the support plate 2 of support frame 100.

Timing wheel 12 is freely rotatably mounted on a rod 13 parallel to the axis 4 and fixedly secured to a disc 14 extending through an aperture formed in the support plate 2 and frictionally engaged therewith, for supporting a manually operated knob 15 keyed to the disc 14 and rotatable over a calibrated dial (not shown) provided on the external surface of the support plate 2.

One end of a coil spring 16 is attached to the inner face of disc 14, the other end of the coil spring 16 being attached to the face of the timing wheel 12 facing the disc 14. The disc 14 has a pin 14*a* at a certain portion on the inner face thereof and the timing wheel 12 has a stop pin 12*a* at a corresponding portion on the face thereof facing the disc 14. Timing wheel 12 is therefore adapted to be rotated by energy stored in the spring 16 which serves as a motor spring, and which is rewound by the rotation imparted to knob 15. When the timing wheel 12 has rotated through a first predetermined angle under the action of the coil spring 16, the stop pin 12*a* on the timing wheel 12 presses the pin 14*a* on the disc 14 for inhibiting further rotation of the timing wheel 12.

Timing wheel 12 has at the periphery thereof and in front of the stop pin 12*a* a teethless portion 12*b* extending over a relatively small angle so that, when after rotation through a second predetermined angle of the timing wheel 12 imparted by the pinion 8, this teethless portion 12*b* registers with the toothed portion 8*d* of the pinion 8, pinion 8 is disengaged from timing wheel 12 and can move axially towards the movable contact plate 17 of the contact assembly 103, as will be explained herebelow.

A description of the operation of the previously described timing device will now be given.

Before the timing device is started in operation, the contact between the movable contact plate 17 and the fixed contact plate 18 is closed. The weighted balls 6 are in their inward position within the dished track 5*a* of the holder 101, whereby the toothed driving portion 8*d* of pinion 8 and the toothed driven portion 12*c* of timing wheel 12 are spaced a predetermined distance apart, this distance being slightly larger than the distance between the top of the actuating cap 8*a* of pinion 8 and the movable contact plate 17.

The duration of the timing is preset by turning knob 15, and thus disc 14, to the graduation marked on the calibrated dial and corresponding to the desired interval, whereby the timing wheel 12 is rotated, for instance clockwise, by coil spring 16 until stop pin 12*a* of the timing wheel 12 presses the pin 14*a* of disc 14, the teethless portion 12*b* of timing wheel 12 and pinion 8 being angularly spaced said second predetermined angle apart.

As the motor 10 is energized by external means, it rotates holder 101 counter clockwise through the gear 110 at a fast rate of speed, and switch 102 also counterclockwise through the gear 11 at a lower rate of speed, the first toothed portion 9 of switch 102 being driven by the axial portion of gear 11 adjacent the gear box 105.

Upon rotation of the holder 101, the weighted balls 6 move outwardly against the dished face 5*a* of the holder 101 under the action of the centrifugal force. The weighted balls 6 serve to force the actuating member 7 to move axially and slide along the axis 4, the member 7 actuating the switch 102 for axially moving the latter along the axis 4 and towards the movable contact plate 17. As the switch 102 is moving along the axis 4, the toothed driven portion 9 of switch 102 remains in engagement with the gear 11 having a rather great axial length.

Upon rotation of the holder 101, pinion 8, which is still rotated by the gear 11, is moved axially, against the action of the movable contact plate 17, to a first position in which the toothed portion 8*d* engages the toothed portion 12*c* of the timing wheel 12, the actuating cap 8*a* of same pinion 8 having almost simultaneously pushed the movable contact plate 17 to thereby open the contact between the movable contact plate 17 and the fixed contact plate 18. As soon as the pinion 8 engages the timing wheel 12, the timing wheel 12 is rotated counter-clockwise, against the action of the spring 16, through the toothed portion 8*d* of pinion 8, this instant being the beginning of the timing.

The pinion 8 is prevented from keeping on moving axially by the hereinabove described plane 8*c* which abuts against the teeth of the toothed portion 12*c* of the timing wheel 12.

After rotation of the timing wheel 12 through the above mentioned second predetermined angle, the teethless portion 12*b* of the timing wheel 12 registers with the pinion 8, whereby the teeth of the toothed portion 8*d* are disengaged from the timing wheel 12, thus allowing the pinion 8, under the action of the weighted balls 6 and the actuating member 7, to move axially along the axis 4 from the first position to a second position, so that the actuating cap 8*a* of pinion 8 pushes the movable contact plate 17 to thereby, in the second position of the cap 8*a*, close the contact between the movable contact plate 17 and the fixed contact plate 19, this moment being the end of the timing. Then, the contact between the movable contact plate 17 and the fixed contact plate 19 remains closed, as long as the motor 10 remains energized, the timing wheel 12 being maintained in position by the teethless part 8*e* of the pinion 8 adjacent the toothed driving portion 8*d* thereof and engaging the teethless portion 12*b* of the timing wheel 12. When the motor 10 is deenergized, switch 102 is forced by the movable contact plate 17 to move axially in the reverse direction towards the support plate 1 to its normally inoperative state, the contact between the movable contact plate 17 and the fixed contact plate 19 is opened, and the contact between the movable contact plate 17 and the fixed contact plate 18 is closed. The timing wheel 12, whose teethless portion 12*b* is then disengaged from the pinion 8, can be moved back to its initial position under the action of the coil spring 16, initial position in which the stop pin 12*a* of the timing wheel 12 abuts against the pin 14*a* of the disc 14.

The invention has been described in detail with particular reference to a preferred embodiment thereof, but it will be understood that variations and modifications can be effected within the spirit and scope of the invention, which are rather defined by the appended claims.

I claim:

1. A timing device including a support frame, comprising two support plates, a switch, a centrifugal mechanism and a timing wheel held between said two support plates, said switch and centrifugal mechanism being freely rotatable and co-axially mounted on a first axis secured to one of said support plates, and a synchronous motor secured to said support frame for rotating said switch at a low rate of speed and said centrifugal mechanism at a faster rate of speed through two driving gears mounted on the motor shaft and engaging two toothed driven portions formed on said switch and said centrifugal mechanism, respectively, said timing wheel being freely rotatable on a second axis fixedly secured to a disc frictionally engaged with said one support plate and having a manually rotatable knob keyed thereto, said timing wheel, for setting the duration of the timing, being rotated through a first predetermined angle by a biasing coil spring whose ends are attached to said disc and timing wheel, respectively, said timing wheel having a toothed driven portion and a teethless portion at the periphery thereof, said centrifugal mechanism being provided with a dished track receiving freely riding weighted balls to axially move an actuating member disposed between said centrifugal mechanism and said switch, and a toothed driving portion being formed on said switch for engaging said toothed driven portion of said timing wheel, whereby upon energization of said synchronous motor, said switch is moved axially in a direction parallel to the rotary axis of the timing wheel by said actuating member under the action of said centrifugal mechanism to a first position in which the toothed driving portion of the switch engages said toothed driven portion of the timing wheel, said switch being prevented from keeping on moving axially by the teeth of the toothed driven portion of the timing wheel against which abuts a teethless part of said switch adjacent the toothed driving portion thereof until said timing wheel has been rotated by said toothed driving portion of said switch through a second predetermined angle so that said teethless portion of the timing wheel registers with said switch and the toothed driving portion of the switch is disengaged from the timing wheel, whereupon said switch is moved axially to a second position and the timing wheel is maintained in position by said teethless part of the switch, the deenergization of the synchronous motor allowing the switch to move in the reverse direction to its normally inoperative state and thus, through the disengagement of the teethless portion of the timing wheel from the switch, allowing the timing wheel to move back to its initial position under the action of said coil spring.

2. A timing device including a support frame, comprising two support plates, a contact assembly, a switch, a centrifugal mechanism and a timing wheel held between said two support plates, said switch and centrifugal mechanism being freely rotatable and co-axially mounted on a first axis secured to one of said support plates, and a synchronous motor secured to said support frame for rotating said switch at a low rate of speed and said centrifugal mechanism at a faster rate of speed through two driving gears mounted on the motor shaft and engaging two toothed driven portions formed on said switch and said centrifugal mechanism, respectively, said timing wheel being freely rotatable on a second axis fixedly secured to a disc frictionally engaged with said one support plate and having a manually rotatable knob keyed thereto, said timing wheel, for setting the duration of the timing, being rotated through a first predetermined angle by a biasing coil spring whose ends are attached to said disc and timing wheel, respectively, said timing wheel having a toothed driven portion and a teethless portion at the periphery thereof, said centrifugal mechanism being provided with a dished track receiving freely riding weighted balls to axially move an actuating member disposed between said centrifugal mechanism and said switch, and a toothed driving portion being formed on said switch, adjacent an integral cap thereof, for engaging said toothed driven portion of said timing wheel, whereby upon energization of said synchronous motor, said switch is moved axially in a direction parallel to the rotary axis of the timing wheel by said actuating member under the action of said centrifugal mechanism to a first position in which the toothed driving portion of the switch engages said toothed driven portion of the timing wheel, said integral cap of said switch pushing simultaneously a movable contact plate of said contact assembly to open a contact between said movable contact plate and a first fixed contact plate of said contact assembly, said switch being prevented from keeping on moving axially by the teeth of the toothed driven portion of the timing wheel against which abuts a teethless part of said switch adjacent the toothed driving portion thereof until said timing wheel has been rotated by said toothed driving portion of said switch through a second predetermined angle so that said teethless portion of the timing wheel registers with said switch and the toothed driving portion of the switch is disengaged from the timing wheel, whereupon said switch is moved axially to a second position and the timing wheel is maintained in position by said teethless part of the switch so that said integral cap of the switch pushes said movable contact plate to close a contact between said movable contact plate and a second fixed contact plate of said contact assembly, the deenergization of the synchronous motor allowing the switch to move in the reverse direction to its normally inoperative state under the action of said movable contact plate and thus, through the disengagement of the teethless portion of the timing wheel from the switch, allowing the timing wheel pushing said integral cap of the switch to move back to its initial position under the action of said coil spring.

* * * * *